US008624496B2

(12) United States Patent
Neubauer et al.

(10) Patent No.: US 8,624,496 B2
(45) Date of Patent: Jan. 7, 2014

(54) PHASE AND FREQUENCY LOCKED MAGNETRON

(75) Inventors: Michael Neubauer, Sonoma, CA (US); Milorad Popovic, Warenville, IL (US); Rolland P. Johnson, Newport News, VA (US)

(73) Assignee: Muons, Inc., Newport News, VA (US)

( * ) Notice: Subject to any disclaimer, the term of this patent is extended or adjusted under 35 U.S.C. 154(b) by 390 days.

(21) Appl. No.: 12/908,578

(22) Filed: Oct. 20, 2010

(65) Prior Publication Data

US 2011/0254443 A1 Oct. 20, 2011

Related U.S. Application Data

(60) Provisional application No. 61/253,470, filed on Oct. 20, 2009.

(51) Int. Cl.
*H01J 25/50* (2006.01)

(52) U.S. Cl.
USPC ..... 315/39.51; 315/39.55; 315/39.77

(58) Field of Classification Search
USPC ..... 315/500, 501, 502, 503, 504, 506, 315/39.51, 39.53, 39.55, 39.57, 39.71, 315/39.75, 39.77; 331/90, 39.59, 39.61; 330/47
See application file for complete search history.

(56) References Cited

U.S. PATENT DOCUMENTS

| | | | | |
|---|---|---|---|---|
| 3,599,035 | A | 8/1971 | Frerichs | |
| 4,331,935 | A * | 5/1982 | Thornber | 331/90 |
| 4,362,917 | A * | 12/1982 | Freedman et al. | 219/730 |
| 4,571,552 | A * | 2/1986 | Brown | 330/47 |
| 5,515,011 | A * | 5/1996 | Pasco | 331/5 |
| 7,023,137 | B2 * | 4/2006 | Ishii et al. | 315/39.51 |
| 7,767,064 | B2 | 8/2010 | Pavloff et al. | |

FOREIGN PATENT DOCUMENTS

GB 2266180 A * 10/1993

* cited by examiner

*Primary Examiner* — Jimmy Vu
*Assistant Examiner* — Borna Alaeddini
(74) *Attorney, Agent, or Firm* — Williams Mullen

(57) ABSTRACT

A magnetron of improved performance capable of stabilizing the frequency and phase of magnetron output for use in particle accelerators and other applications. Thin variable-permeability blocks are attached inside the resonant anode structures of a standard magnetron design. A variable bias electromagnet, with field orthogonal in direction to the RF magnetic field, is used to vary the permeability of each block and therefore the resonant frequency of each anode structure. An electronic feedback control circuit adjusts the bias magnetic fields to lock in the frequency and phase of the magnetron output to an external low-level reference signal. Such devices may be used to provide synchronized high-power RF to many locations (e.g. the RF cavities of a particle accelerator), while requiring the distribution only of electrical power and an appropriate low-level RF reference signal.

7 Claims, 8 Drawing Sheets

PHASE AND FREQUENCY LOCKED MAGNETRON

CROSS-REFERENCE TO RELATED APPLICATION

The present application claims the benefit of U.S. Provisional Patent Application No. 61/253,470, filed Oct. 20, 2009, the entire disclosure of which is hereby incorporated by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of USDOE Contract No. DE-AC05-84-ER-40150 and STTR Grant DE-SC0002766.

FIELD OF THE INVENTION

The present invention relates to microwave power generation for diverse purposes and, more particularly, to those applications requiring precise control of the phase and frequency of the output power, such as for radiofrequency (RF) devices used in particle accelerators.

BACKGROUND OF THE INVENTION

High-power RF systems are expensive to build and costly to operate because of their inefficiency and unreliability, primarily due to the distribution of high power levels over large distances.

Typically, high-power systems for accelerator applications use multi-megawatt microwave tubes such as klystrons. The RF power gun klystrons is usually distributed to multiple strings of cavities through high-power waveguide systems, which are expensive to produce and to operate, because of reduced efficiency and lower reliability of the distribution system. In such systems, the final power output stage is an amplifier; this gives inherently good phase and frequency control from a low-level RF reference signal, at the cost of significantly reduced efficiency.

There have been several previous attempts to control the phase and frequency of magnetrons. Unfortunately, none of those techniques have proven to be sufficiently stable, flexible, and accurate enough for use in particle accelerators.

It would also be advantageous to use the inherently high efficiency of a magnetron to provide the RF power.

It would further be advantageous to improve the phase and frequency stability of the RF output of a magnetron to make it suitable for particle accelerators and other applications.

SUMMARY OF THE INVENTION

A magnetron is provided having an anode structure oriented about an axis. The anode structure defines an interior chamber and has a plurality of vanes extending from an interior surface of an exterior wall radially into the interior chamber and terminating at a vane tip. There is a plurality of vanes in which each pair of vanes defines a cavity forming a plurality of cavities within the interior chamber and each of the plurality of cavities has a resonant frequency. A cathode is aligned substantially along the axis with the plurality of vanes and the cathode configured so as to define a first gap between each of the vane tips of the plurality of vanes and the cathode.

The cathode and anode are configured to create a radio frequency (RF) field. A conductive output is provided for receiving an output signal from an output coupler or antenna disposed within at least one of the plurality of cavities and in electrical communication with the conductive output.

Additionally, a magnetron magnet is configured to create an axially aligned magnetic field within the interior chamber and a plurality of variable-permeability blocks, where each of the variable-permeability blocks is magnetic-field-dependent and orthogonally-biased with respect to the RF field with a surface exposed within at least one of the plurality of cavities internally through the anode wall for changing the resonant frequency of each of the plurality of cavities of the anode structure. Integrally coupled with, and exterior to, the anode wall structure while in radial alignment with the inner chamber axis are a plurality of variable-strength, localized-field bias magnets. The localized-field bias magnets are for changing the permeability of each of the plurality of variable-permeability blocks where the variable-permeability blocks are magnetically connected to the plurality of bias magnets where each of the plurality of bias magnets has an electrical coil or winding.

A feedback control circuit may be in communication with the conductive output, an RF reference signal source generating an RF reference signal, and to the coils of the plurality of bias magnets. The feedback control circuit is configured to detect an output signal at the conductive output, to detect the reference signal, to compare the output signal to the reference signal and calculate desired settings for a bias magnet current. A bias magnetic current to be applied to the coils of the plurality of bias magnets is generated based on the comparison and applied to the bias magnet current to the coils of the plurality of bias magnets.

The feedback control circuit may be configured to detect an output signal frequency, to detect a reference signal frequency, to compare the output signal frequency to the reference signal frequency, and to calculate desired settings for a bias magnet current to be applied to the coils of the plurality of bias magnets based on the comparison, and to generate and apply the bias magnet current to the coils of the plurality of bias magnets together to control the output signal frequency.

The feedback control circuit may be configured to detect an output signal phase, to detect a reference signal phase, to compare the output signal phase to the reference signal phase, and to calculate desired settings for a bias magnet current to be applied to the coils of the plurality of bias magnets based on the comparison, and to generate and apply the bias magnet current to the coils of the plurality of bias magnets individually to control the output signal phase.

The feedback control circuit may be additionally configured to detect an output signal frequency, to detect an output signal phase, to detect a reference signal frequency, to detect a reference signal phase, to compare the output signal frequency to the reference signal frequency, to compare the output signal phase to the reference signal phase, to calculate desired settings for a bias magnet current to be generated and applied to the coils of the plurality of bias magnets based on the comparisons, and to apply the bias magnet current to the coils of the plurality of bias magnets together to control the output signal frequency and individually to control the output signal phase.

Each of the plurality of variable-permeability blocks is disposed within the cavity of each of the plurality of cavities.

The variable-permeability blocks may be materials such as ferrite, yttrium iron garnet (YIG) or yttrium aluminum garnet (YAG).

BRIEF DESCRIPTION OF THE DRAWINGS

A complete understanding of the present invention may be obtained by reference to the accompanying drawings.

For purposes of clarity and brevity, like elements and components will bear the same designations and numbering throughout the Figures.

DETAILED DESCRIPTION

The present device uses a different approach, and is based on a variable-permeability material in the resonant structures of a magnetron. The permeability of a material is its degree of internal magnetization in response to an applied magnetic field. When a permeable material is placed in or around an RF resonant structure, the permeability of the material affects the resonant frequency of the structure due to the material's response to the rapidly varying RF magnetic field. Some materials, such as ferrite or Yttrium Iron Garnet, exhibit a permeability that can be varied by application of a magnetic field that is orthogonal to the RF magnetic field. This permits a bias magnetic field to control the resonant frequency of the structure.

In order to sustain oscillations in a resonant circuit, it is necessary to continuously input energy in the correct phase.

In accordance with the present invention, there is provided an apparatus to improve the operation of a conventional magnetron RF power system, by phase and frequency locking its output to an externally-supplied low-level reference signal. Blocks of a variable-permeability material are affixed into the resonant anode structures of a magnetron. A variable bias electromagnet generates a magnetic field within them to vary their permeability and therefore the resonant frequency of each resonant anode structure. The bias electromagnets may be changed together to control the frequency of the output RF power. One or a few of the bias electromagnets may be changed to control the phase of the output RF power. A feedback loop controls the bias electromagnets to minimize the phase and frequency differences between the external low-level reference signal and the magnetron RF output. It would be advantageous to provide high-power RF sources that can be placed where the power is needed, without high-power distribution systems, such that they are phase and frequency locked to a low-level RF reference signal (which is much easier to distribute).

Figure 1:
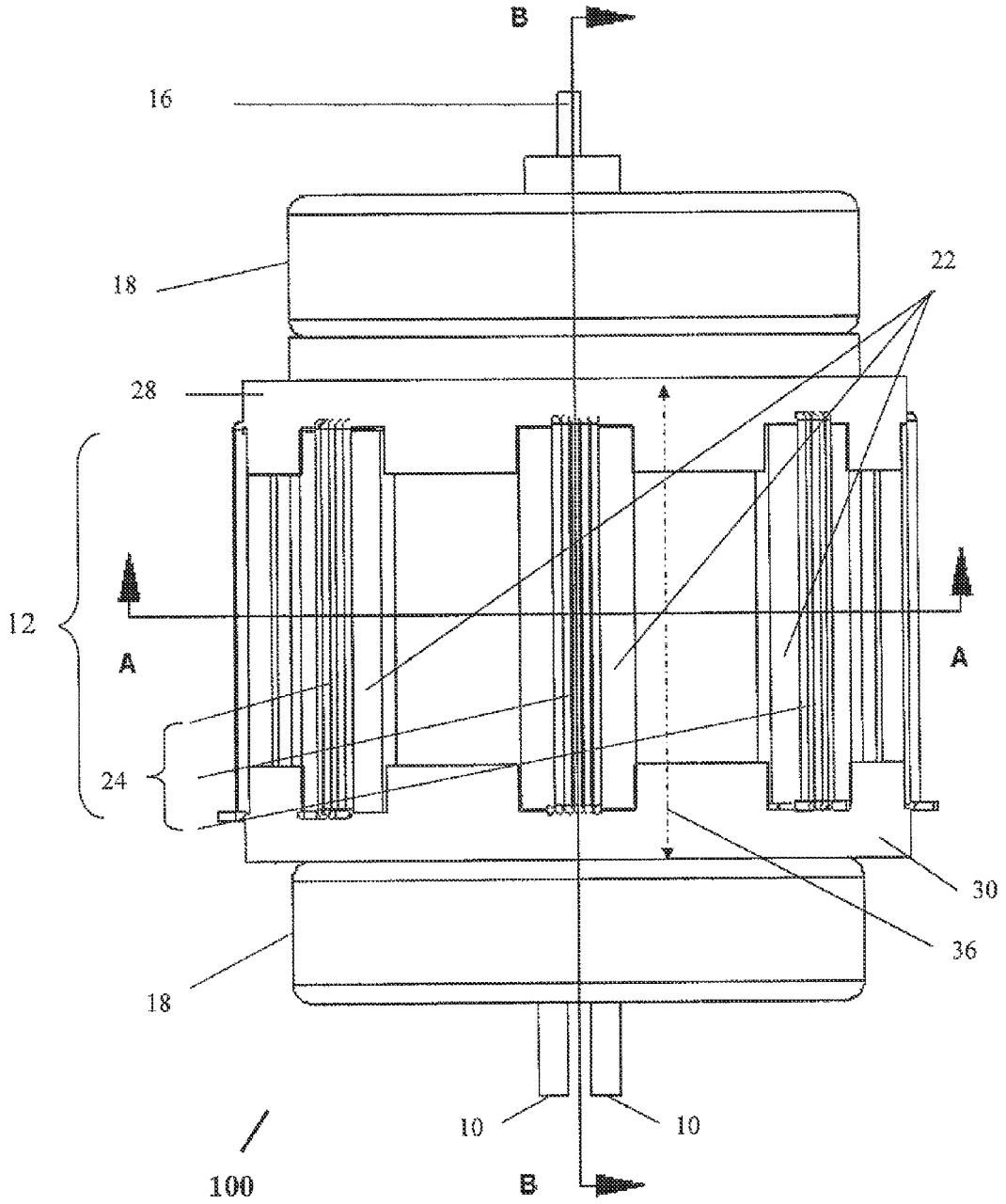
FIG. 1 is a side view of a phase and frequency locked magnetron.

FIG. 1 is a side view of an embodiment of a phase and frequency locked magnetron 100. With an applied voltage, electrons are emitted from the cathode 10. The electrons are accelerated by the externally-supplied electric potential difference between the cathode 10 and the anode structure 12, which is shown in more detail in FIG. 2. The magnetron magnet 18 generates an axial RF magnetic field 36 that causes the electrons to spiral, where they pass the first resonant gaps 34 (shown in FIG. 2) in the anode structure 12, exciting them with RF power. The output coupler 14 (shown in FIG. 2) than transmits this RF power to the output terminal 16. The output coupler 14 may be a copper or metallic device that connects at least one anode vane 32 to the output terminal 16. For high power operation, preferably the magnetron 100 includes a cooling system such as fins for air cooling, or external water cooling. Also shown are an upper anode case 28 and a lower anode case 30.

A feedback control circuit 30 (schematically shown in FIG. 10) is connected, in electrical communication, to the output terminal 16, to an external low-level RF reference signal, and to the coils 24 of each bias magnet 22. Feedback control circuit generates the proper current for the coil 24 of each bias magnet 22 to maintain phase and frequency locking of the output terminal 16 power to the external reference. By appropriately setting the current in all coils 24 together it controls the frequency, and by varying currents individually it controls the phase. Some aspects of its design, such as phase offset, bandwidth, response time, and limits, must be determined specifically for each application. The implementation of the specific design of the feedback control circuit 30 may be a straightforward application of standard control theory.

Figure 2:
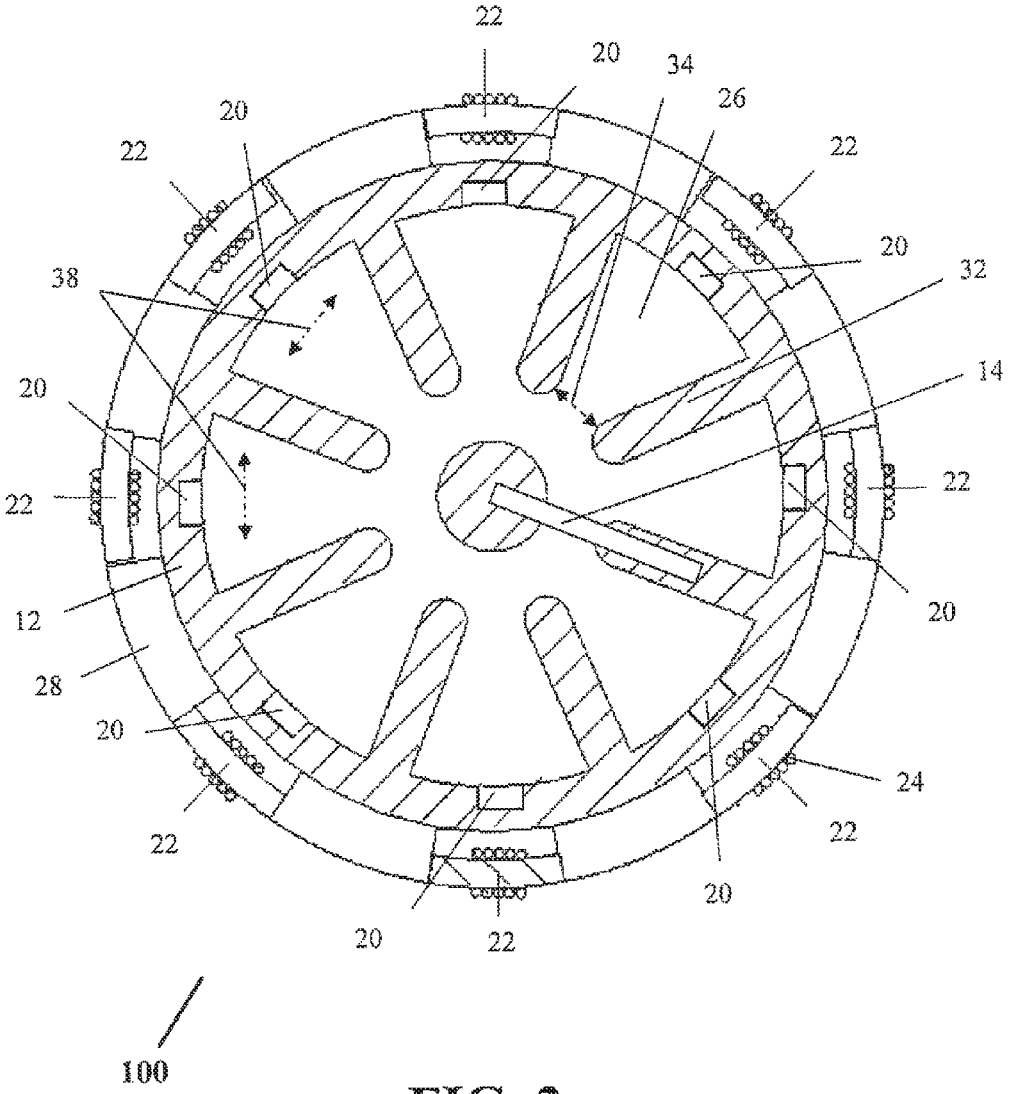
FIG. 2 is a top section view of a phase and frequency locked magnetron, section a-a of FIG. 1

FIG. 2 is a top section view of an embodiment of the magnetron 100, section A-A for the embodiment in FIG. 1. This example shows suggested locations of each variable-permeability block 20, one in each cavity 26 of the anode structure 12. The cavities 26 are defined by a plurality of anode vanes 32. FIG. 2 also shows suggested locations of each bias magnet 22, one for each variable-permeability block 20, with this embodiment. Note the bias magnetic field 38 from each bias magnet 22 is orthogonal to the axial RF magnetic field 36 shown in FIG. 1; this is optimal for biasing each variable-permeability block 20 to control the resonant frequency of each resonant gap 26, 34 in the anode structure 12.

Figure 3:
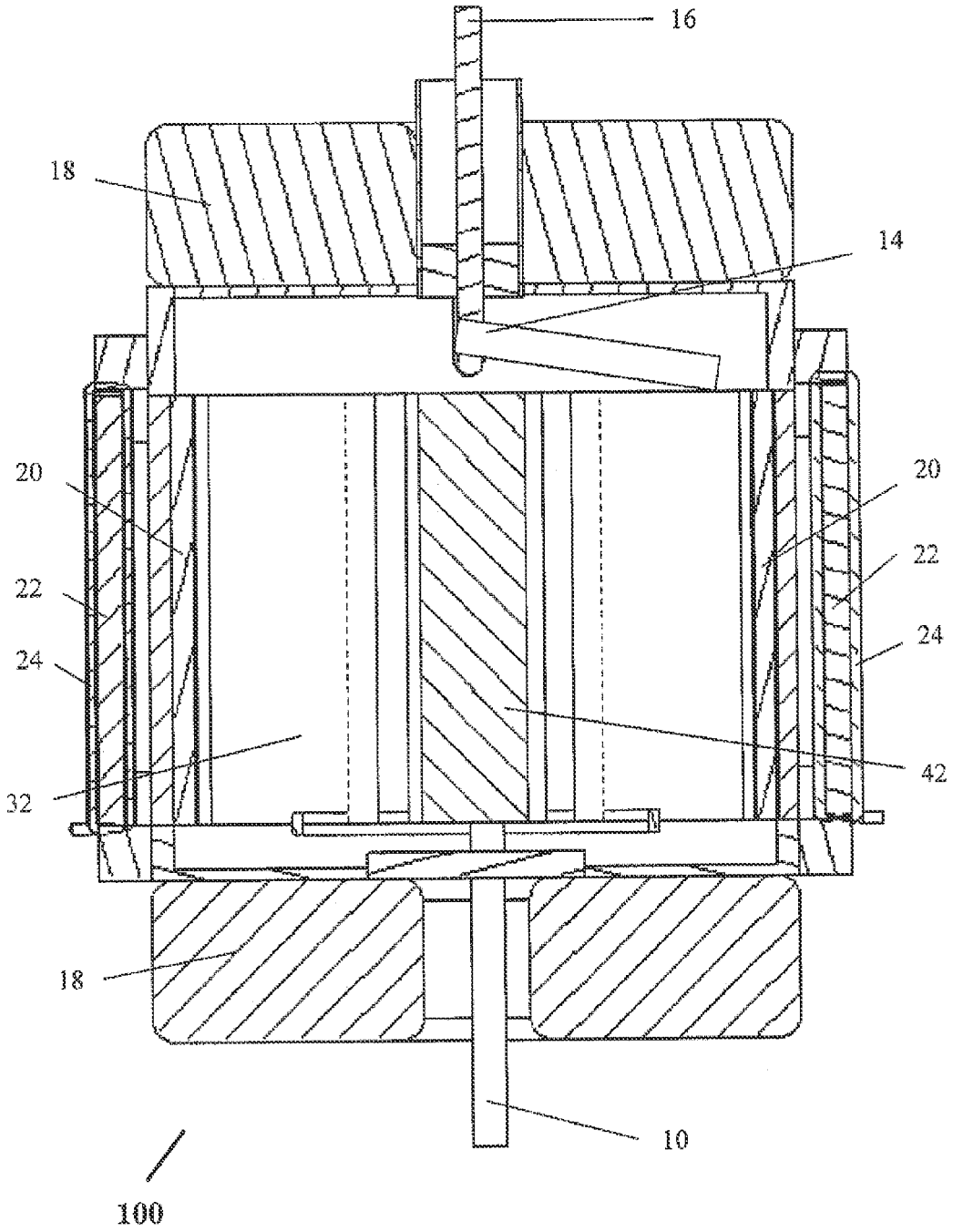
FIG. 3 is a side section view of a phase and frequency locked magnetron, section b-b of FIG. 1.

FIG. 3 is a side section view of an embodiment of phase and frequency locked magnetron 100, section B-B of the embodiment in FIG. 1. It further clarifies the relationships among various components. Output coupler 14 which is electrically connected to at least one of the anode vanes 32 of the anode structure 12 and output terminal 16 are shown as a continuous item, being electrically coupled at the output terminal 16 axis. Also shown is the internal cathode 42. The dashed lines represent the break of the curvature of the ends of the anode vane(s) 32 in this embodiment. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Typically, high power sources for accelerator applications are multi-megawatt microwave tubes that may be combined together to form ultra-high-power localized power stations. The RF power is then distributed to multiple strings of cavities through high power waveguide systems, which as noted can be problematic in terms of expense, efficiency, and reliability. Magnetrons are a low cost microwave source in dollars/kW, and they have the highest efficiency (typically greater than 85%). However, the frequency stability and phase stability of conventional magnetrons are not adequate, when used as power sources for accelerators. The present approach may be utilized to phase and frequency lock magnetrons, allowing their use for either individual cavities or, for cavity strings. Ferrite or YIG materials may be attached in the regions of high magnetic field of radial-vaned, π-mode structures of a selected ordinary magnetron. A variable external magnetic field that is orthogonal to the magnetic RF field of the magnetron can surround the magnetron to vary the permeability of the ferrite or YIG material.

A number of systems have been developed to try to stabilize the magnetron frequency and phase. Some techniques employ high-Q cavities, some employ magnetrons with a resonator element for stabilizing output radiation frequency, while others use active devices such as PIN diodes in output waveguide structures. However, these techniques tend to be power limiting and produce lowered efficiencies because of added losses. External feedback circuits have been done with attempts at phase locking and injection locking with some good results. In fact, there have been some reports of being able to stabilize a magnetron with a feedback loop, such that, in effect a 30 db gain amplifier could be realized.

Thus, the present system is significantly different from other attempts to stabilize magnetrons. Material is added to the inside of the anode structure that enables both phase locking of the magnetron as well as adjusting of its operating frequency with a feedback loop controlling a DC magnetic field.

Figure 4:
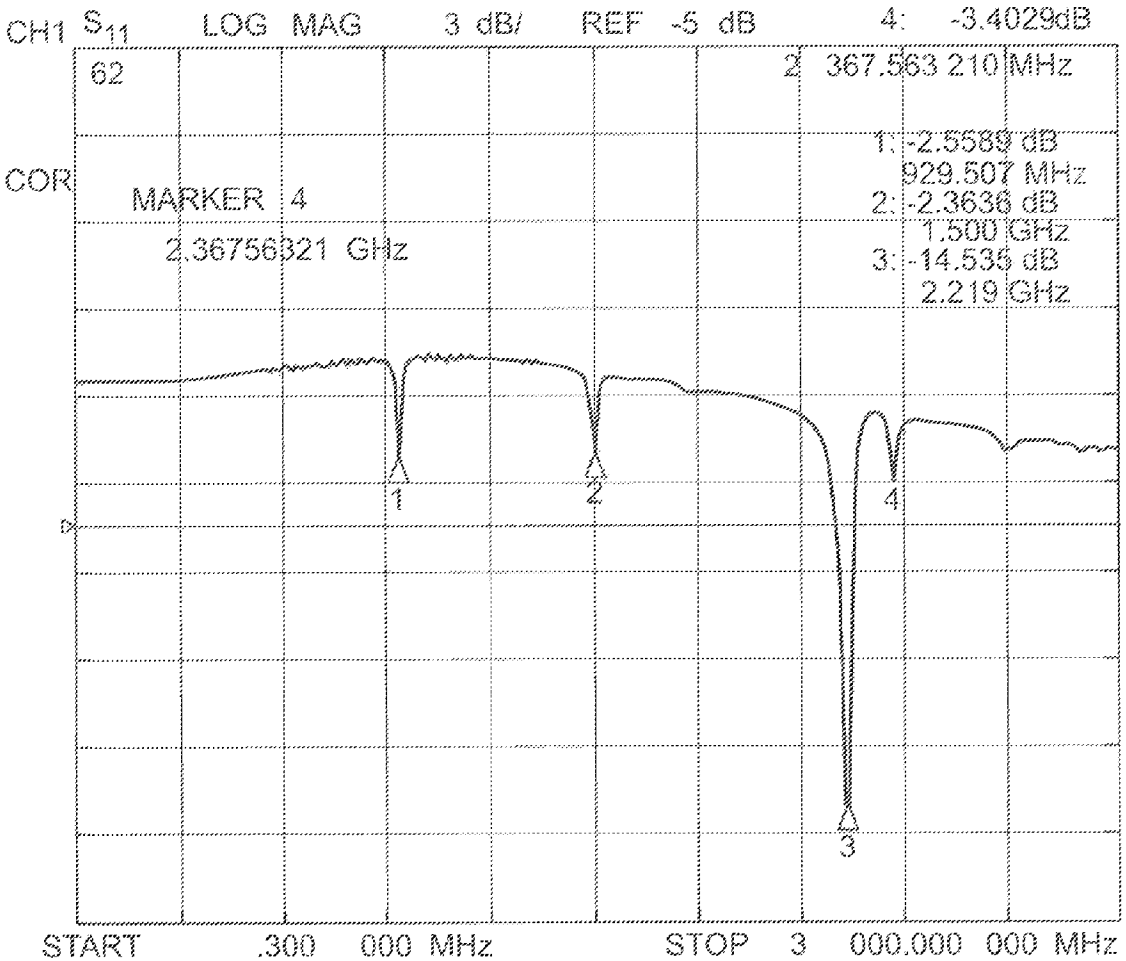
FIG. 4 shows a frequency sweep of the magnetron without using ferrite or YIG.

By way of comparison, FIG. 4 shows a frequency sweep of a magnetron without using ferrite or YIG material.

A test embodiment was built using a rod captured into a wall as variable-permeability block 20.

A three dimensional model was made and the results of the calculations and measurements are shown in Table 1. The measured results compare very well to the calculations. The errors can usually be attributed to the standard problems found in construction of a test embodiment in which the surfaces of the assembly pieces may not quite touch, and in the model where two such mechanical surfaces are treated as one.

Table 1 below compares the calculated and measured values of the test fixture. The TM010 is the mode in the coupling cavity.

TABLE 1

| Phase Shift per Cell | Calculated (MHz) | Measured (MHz) |
|---|---|---|
| ξ | 906 | 935.6 |
| ξξ | 1496 | 1500 |
| ξξξ | 2294 | 2219 |
| ξξ | 2872 | 2367 |

Figure 5:
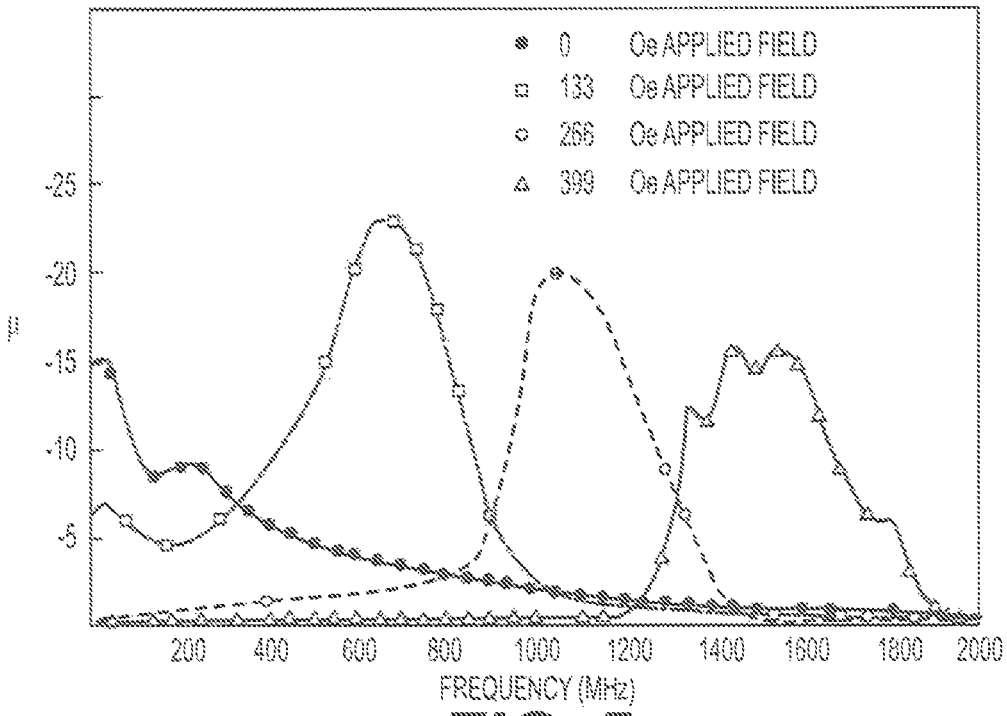
FIG. 5 is an example of yttrium garnet characteristics.

In FIG. 5 an example is shown of yttrium garnet characteristics from studies done with a DC magnetic field orthogonal to the RF fields, where Im(μ) for $Y_3Al_{66}Fe_{434}O_{12}$ yttrium aluminum garnet.

Figure 6:
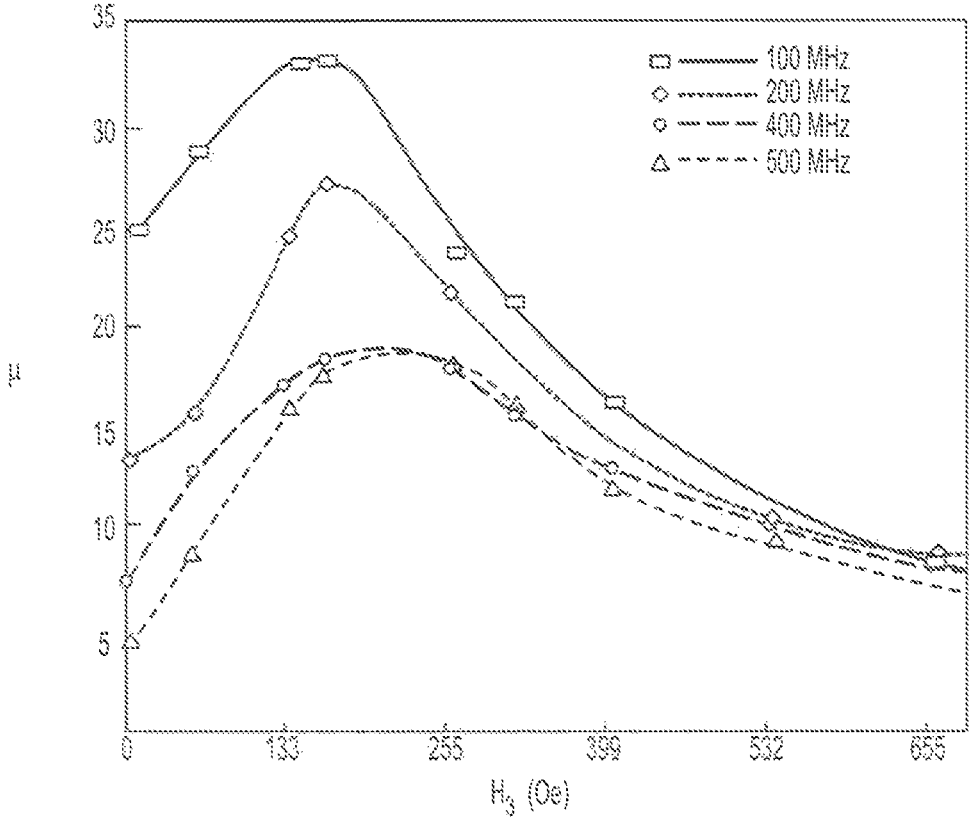
FIG. 6 shows an example of low frequencies where the permeability is directly proportional to magnetic field.

Yttrium garnets have a frequency-sensitive maximum loss that can be tuned based upon the amount of DC magnetic field. It is this loss characteristic in optimal configuration that may be used to dampen the higher order modes of a magnetron. Another characteristic of garnets and ferrites is the fact that at frequencies below the peak in loss, the frequency sensitivity of the real part of the permeability is quite different. At low frequencies, the permeability is directly proportional to magnetic field, going down as the magnetic field increases, and above the peak in loss there is no frequency sensitivity. This characteristic is shown in FIG. 6 for a $Mg_{35}Zn_{65}Fe_2O_4$ magnesium-zinc spinel ferrite. Again, the magnetic field was orthogonal to the RF magnetic field.

Figure 7:
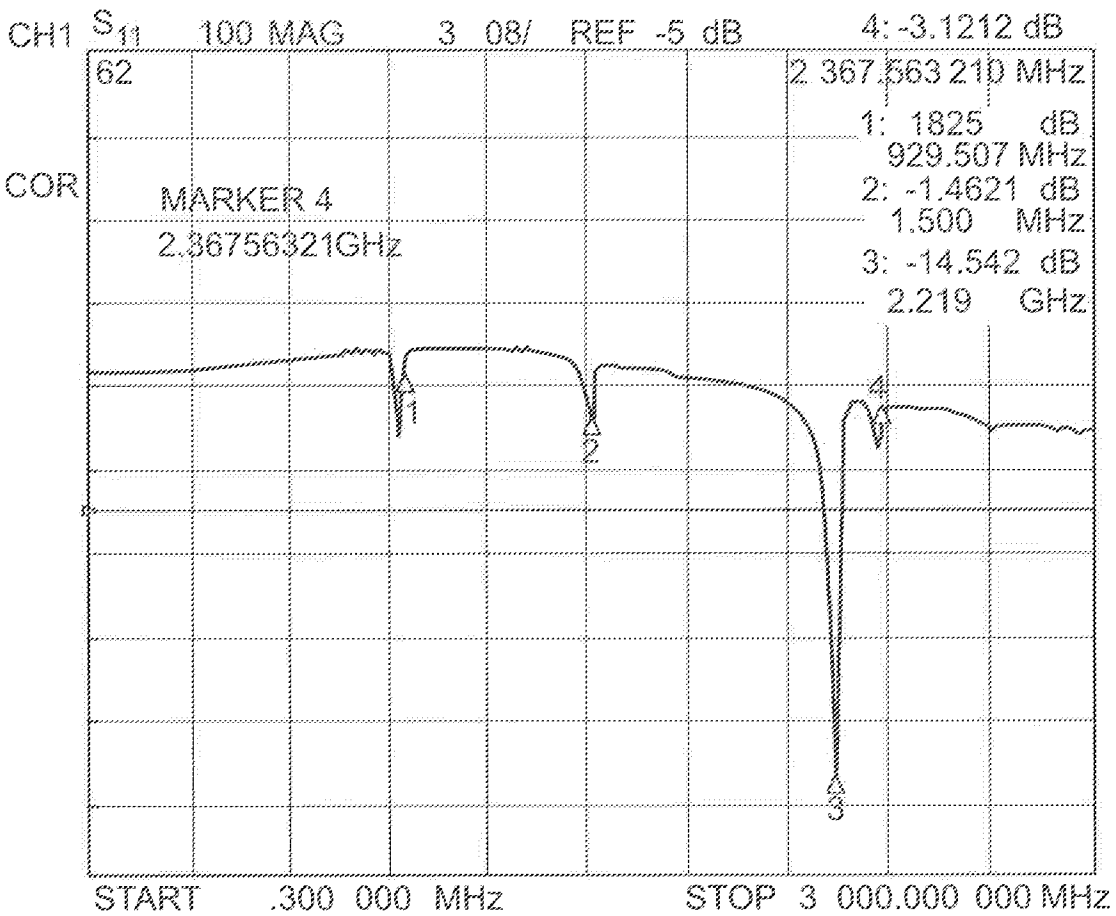
FIG. 7 shows the saturation rate of YIG.

For these studies, the material was yttrium-iron-garnet which has a higher saturization than the yttrium-aluminum-garnet shown in the example data of FIG. 7. The frequency sweep shown is with two YIG rods with a magnetic field 53% of the YIG saturization magnetization.

With two rods inserted in opposite cells, the π-mode frequency change was 12.2 MHz, resulting from an applied DC magnetic field of 950 gauss.

Figure 8:
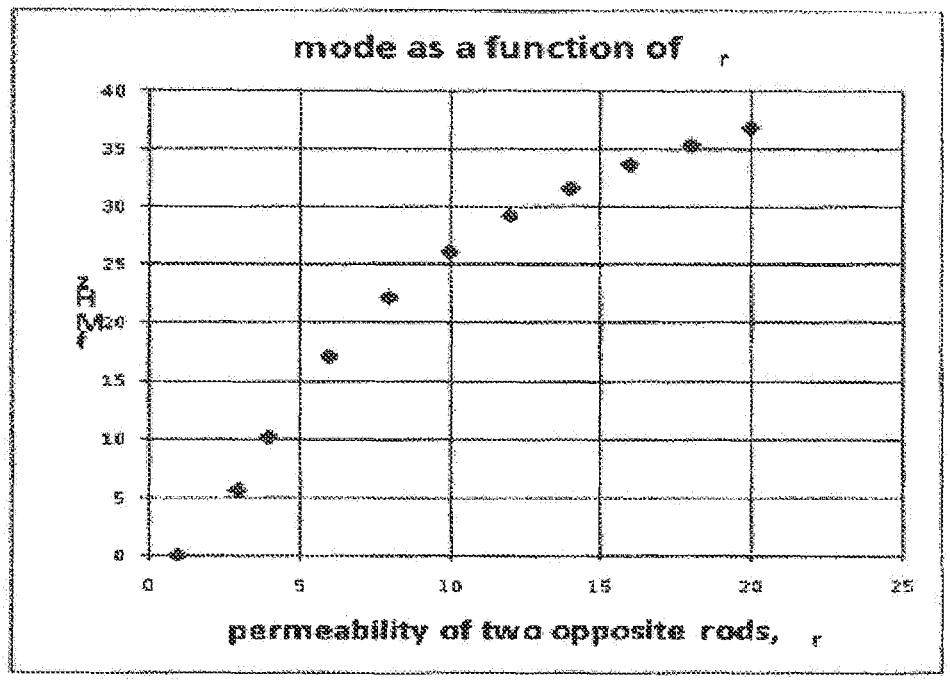
FIG. 8 shows an estimated real part of the permeability of the test data from FIG. 7.

From FIG. 8, the estimated real part of the permeability for the previous test was $\mu_r$=5. A change of 12 MHz is quite large for this frequency magnetron, where a ±5 MHz tune-ability would greatly improve the efficiency of a phase array system. FIG. 8 also shows the calculation of the change in frequency as a function of the permeability of two rods in the anode structure Note how much the Q changes due to the loss in the YIG rods. Without an applied DC magnetic field, the rods exhibit a loss so significant that it dampens the π-mode. With the applied field the loss decreases when operating below the resonant frequency of the YIG rods. Further evidence indicates operation below the resonant frequency of the YIG, since the real part of the permeability decreased with increasing frequency, and the next nearest mode did not change in frequency. This implies a $\mu_r$~1 at the next nearest mode.

Figure 9:
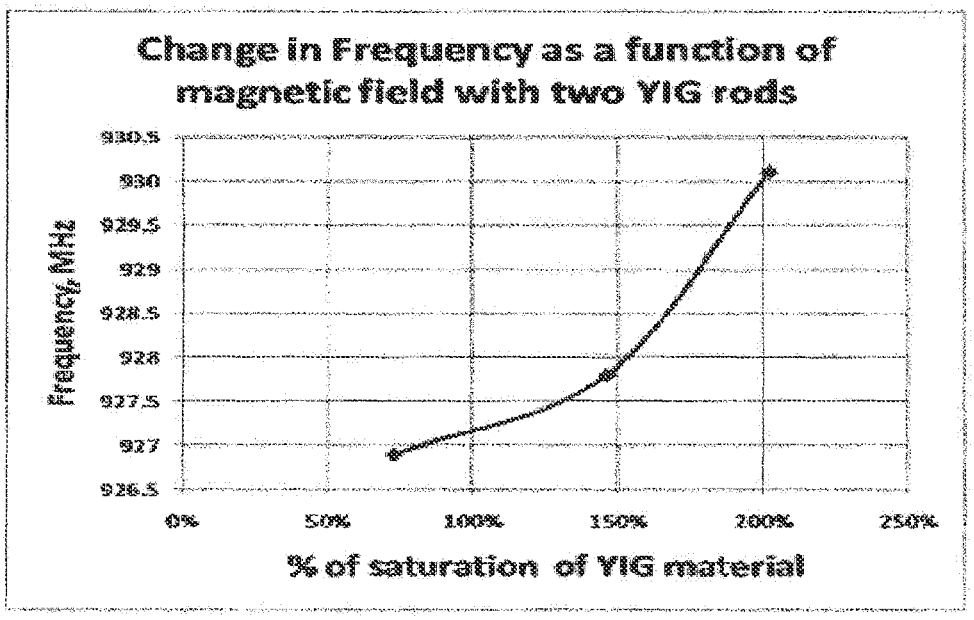
FIG. 9 shows a change in frequency for an applied DC magnetic field as a percentage of the saturization magnetization of the YIG material.

FIG. 9 shows a change in frequency for an applied DC magnetic field as a percentage of the saturization magnetization of the YIG material.

Figure 10:
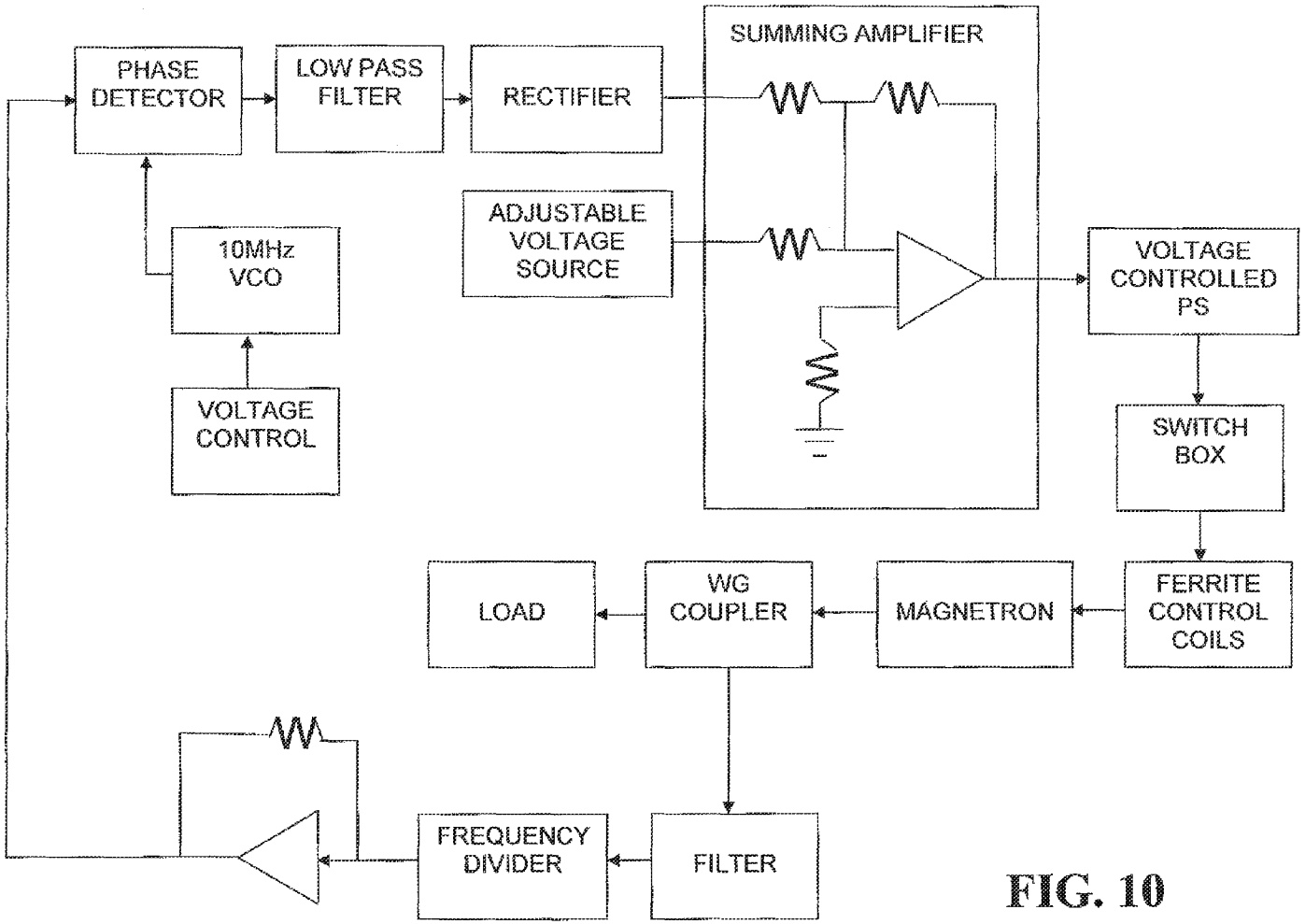
FIG. 10 is a block diagram showing fundamental components in an embodiment of the feedback function.

The particular details of the feedback circuit will depend on the application, and the characteristic of the ferrite or garnet materials to be used in the cells. The block diagram shown in FIG. 10 shows the fundamental components of an embodiment of a feedback control circuit an adjustable voltage source (1) may be used to create a bias condition that is always on, for example, to avoid a loss in the ferrite or garnet that will attenuate any resonance. A voltage control (2) may be used to adjust the locked frequency to a desired valued within the overall operating range of the device. A switch box (3) is used to control the current to the individual solenoids that control the material characteristics of one rod in one of the ten cells.

The use of yttrium garnet rods has been demonstrated in a test fixture model of a magnetron anode. The change in frequency is as predicted for this type material and a DC magnetic field. Other materials will be experimented with that require less applied magnetic field.

What is claimed is:

1. A magnetron comprising:

an anode structure oriented about an axis, the anode structure defining an interior chamber and having a plurality of vanes extending radially into the interior chamber and terminating at a vane tip, with each pair of the plurality of vanes defining a cavity to form a plurality of cavities within the interior chamber and each of the plurality of cavities has a resonant frequency;

a cathode aligned substantially along the axis, the plurality of vanes and the cathode configured so as to define a first gap between the vane tips of the plurality of vanes and the cathode, wherein the cathode and anode are configured to create an RF field;

a conductive output terminal for receiving an output signal;

an output coupler disposed in communication with at least one of the plurality of vanes and in electrical communication with the conductive output terminal;

a magnetron magnet configured to create an axially aligned magnetic field within the interior chamber;

a plurality of variable-permeability blocks affixed in the anode structure, wherein each of the variable-permeability blocks is magnetic-field-dependent and orthogonally-biased with respect to the RF field, for changing the resonant frequency of each of the plurality of cavities of the anode structure;

a plurality of variable-strength, localized-field bias magnets, for changing the permeability of each of the plurality of variable-permeability blocks, magnetically connected to said variable-permeability blocks, each of the plurality of bias magnets having a coil;

a feedback control circuit in communication with the conductive output, an RF reference signal source generating an RF reference signal, and to the coils of the plurality of bias magnets; and wherein the feedback control circuit is configured to detect an output signal at the conductive output terminal, to detect the reference signal, to compare the output signal to the reference signal, to calculate desired settings for a bias magnet current to be applied to the coils of the plurality of bias magnets based on the comparison, and to generate and apply the bias magnet current to the coils of the plurality of bias magnets.

2. The magnetron of claim 1, wherein the feedback control circuit is configured to detect an output signal frequency, to detect a reference signal frequency, to compare the output signal frequency to the reference signal frequency, and to calculate desired settings for a bias magnet current to be applied to the coils of the plurality of bias magnets based on the comparison, and to generate and apply the bias magnet current to the coils of the plurality of bias magnets together to control the output signal frequency.

3. The magnetron of claim 1, wherein the feedback control circuit is configured to detect an output signal phase, to detect a reference signal phase, to compare the output signal phase to the reference signal phase, and to calculate desired settings for a bias magnet current to be applied to the coils of the plurality of bias magnets based on the comparison, and to generate and apply the bias magnet current to the coils of the plurality of bias magnets individually to control the output signal phase.

4. The magnetron of claim 1, wherein the feedback control circuit is configured to detect an output signal frequency, to detect an output signal phase, to detect a reference signal frequency, to detect a reference signal phase, to compare the output signal frequency to the reference signal frequency, to compare the output signal phase to the reference signal phase, to calculate desired settings for a bias magnet current to be generated and applied to the coils of the plurality of bias magnets based on the comparisons, and to apply the bias magnet current to the coils of the plurality of bias magnets together to control the output signal frequency and individually to control the output signal phase.

5. The magnetron of claim 1, wherein each of the plurality of variable-permeability blocks are disposed within the cavity of each of the plurality of cavities.

6. The magnetron of claim 1, wherein the variable-permeability blocks are ferrite.

7. The magnetron of claim 1, wherein the variable-permeability blocks are yttrium iron garnet.

* * * * *